US005139273A

United States Patent [19]

Rudell et al.

[11] Patent Number: 5,139,273

[45] Date of Patent: Aug. 18, 1992

[54] TARGET BALL AND GAME

[75] Inventors: Elliot Rudell, 6556 Sattes Dr., Rancho Palos Verdes, Calif. 90274; George Foster, Signal Hill, Calif.

[73] Assignee: Elliot Rudell, Torrance, Calif.

[21] Appl. No.: 488,224

[22] Filed: Mar. 5, 1990

[51] Int. Cl.[5] ..... A63B 43/00; A63B 67/00

[52] U.S. Cl. ..... 273/346; 273/58 K; 273/DIG. 30

[58] Field of Search ..... 273/346, 58 A, 58 C, 273/58 K, 412, DIG. 30, DIG. 19

[56] References Cited

U.S. PATENT DOCUMENTS

| | | | |
|---|---|---|---|
| 3,032,345 | 5/1962 | Lemelson | 273/346 |
| 3,531,115 | 9/1970 | Alexander | 273/58 C |
| 3,857,566 | 12/1974 | Lemelson et al. | 273/346 |
| 3,917,271 | 11/1975 | Lemelson et al. | 273/346 |
| 3,927,881 | 12/1975 | Lemelson etal. | 273/58 K |
| 4,718,677 | 1/1988 | Barnes | 273/346 X |
| 4,743,030 | 5/1988 | Auer et al. | 273/349 |
| 4,971,334 | 11/1990 | Stewart | 273/346 |
| 4,986,548 | 1/1991 | Conner | 273/346 |

*Primary Examiner*—William H. Grieb
*Attorney, Agent, or Firm*—Plante, Strauss & Vanderburgh

[57] ABSTRACT

There is disclosed a game where the players wear vests with Velcro® surfaced targets and are provided with soft elastic balls surfaced with complimentary Velcro® fabric. The players throw the balls at each other and attempt to stick the balls to the target areas, which can be assigned numerical scores depending on location and exposure. The players can duck or and try to avoid being hit and the player with the highest score wins the game. The invention also includes an elastic, soft ball formed of foamed elastomer which has a single through passageway along a diameter thereof and is partially covered with a plurality of bands of Velcro® attachment fabric which extend along great circle arcs on the exterior surface of the ball and pass through the internal passageway of the ball, thereby securely attaching the Velcro® bands to the ball. This attachment of the bands can be augmented by adhesive bonding between the Velcro® bands and the exterior surface of the ball.

12 Claims, 4 Drawing Sheets

TARGET BALL AND GAME

BACKGROUND OF THE INVENTION

1. Field of Invention

This invention relates to a children's activity game and specifically to a Velcro ® covered game ball and to a target game utilizing the game ball.

2. Brief Statement of the Prior Art

Creativity games are well known and one of the most popular is called "TWISTER" marketed by Milton Bradley Company. In this game one or two players touch unnumbered but colored circles on a vinyl map. A number of attempts have been made to provide games which utilize the conventional hook and loop fastener material which is available under the trade designation Velcro ®. These attempts have been described in a number of prior patents such as U. S. Pat. Nos. 3,032,345, 3,927,881, 3,917,271 and 3,857,566. The aforementioned patents describe games which utilize darts and balls which are covered with Velcro ®.

One of the difficulties in providing a game in which balls will be thrown at other players is to provide a ball that is safe for use and does not present any danger or hazard to the players. This is particularly difficult when Velcro ® is used as the attachment material since Velcro ® type fabrics have, heretofore, only been successfully applied to relatively hard or rigid surfaces, which are not compatible with an activity game in which the balls are thrown at players.

Since the gripping actio of Velcro ® requires substantive support of its backing surface, the backing material is typically Nylon ®, or of similar non-chemically reactive material. As a result, gluing or solvent bonding of Velcro ® strips to rigid balls has, at best, been a less than satisfactory, non-permanent solution. Target games currently on the market, using Velcro ® glued to rigid balls,eventually suffer the fate of the Velcro ® adhering more strongly to the target than the ball, resulting in separation of the Velcro ® from the ball. Some of the Velcro ® strips fall off the balls, leaving the game nearly unplayable. Gluing or solvent bonding Velcro ® strips to a soft foam ball, as desirable for maximum safety to children, is possible but even less permanent or reliable than when glued to a rigid ball, as the Velcro ® hook and loop fasteners adhere more tightly to each other than the bonding within the foam, resulting in tearing away the surface of the foam ball.

One attempt has been made to provide a toss ball construction in which Velcro ® is secured about a light weight, expanded polystyrene ball. This attempt slits a Velcro ® fabric to form a net that is secured about the ball. In this application, of course, an elastic or compressible ball cannot be used as the net formed by the slit Velcro ® fabric requires a relatively non-compressible supporting surface.

The aforementioned patents have been utilized in commercial target games. Essentially these games utilize fixed or stationary targets which are placed on a supporting surface and rigid balls that are covered with Velcro ® type fabrics are thrown against the targets.

OBJECTIVES OF THE INVENTION

It is an object of this invention to provide a children's activity game utilizing a ball that has bands of Velcro ® attachment fabric on its outer surface.

It is a further object of this invention to provide a ball of the aforementioned construction which can be thrown at a player without risk of injury.

It is a further object of this invention to provide an activity game in which one or more players dons wearing apparel which has targets at which other players throw Velcro ®-covered balls of this invention.

It is an object of this invention to provide a soft compressible ball formed of foamed elastomer which is covered with bands of Velcro ® fabric.

It is a further object of this invention to provide a method for securing bands of Velcro ® fabric on the exterior surface of a compressible ball formed of a foamed elastomer.

Other and related objects will be apparent from the following description of the invention.

BRIEF STATEMENT OF THE INVENTION

This invention comprises a spherical body or ball formed of foamed a elastomer, thereby providing an elastic, soft ball. The ball has a single through passageway along a diameter thereof and is partially covered with a plurality of bands of Velcro ® attachment fabric which extend along great circle arcs on the exterior surface of the ball and pass through the internal passageway of the ball, thereby securely attaching the Velcro ® bands to the ball. This attachment of the bands can be augmented by adhesive bonding between the Velcro ® bands and the exterior surface of the ball.

The game of the invention includes a wearing apparel such as a vest which is provided with one or more targets identify with indicia. The vest is formed of the complimentary Velcro ® material or supports patches of the complimentary Velcro ® material to provide attachment sites for the game balls. The game of the invention is practiced by two or more players at least one of which dons the wearing apparel and the other players throw the Velcro ® balls of the invention at the targets while the wearer of the wearing apparel ducks and tries to avoid being hit or attempts to protect the highest value targets from being hit with the balls.

BRIEF DESCRIPTION OF THE DRAWINGS

The invention will be described with reference to the FIGURES, of which.

DESCRIPTION OF PREFERRED EMBODIMENTS

Figure 1:
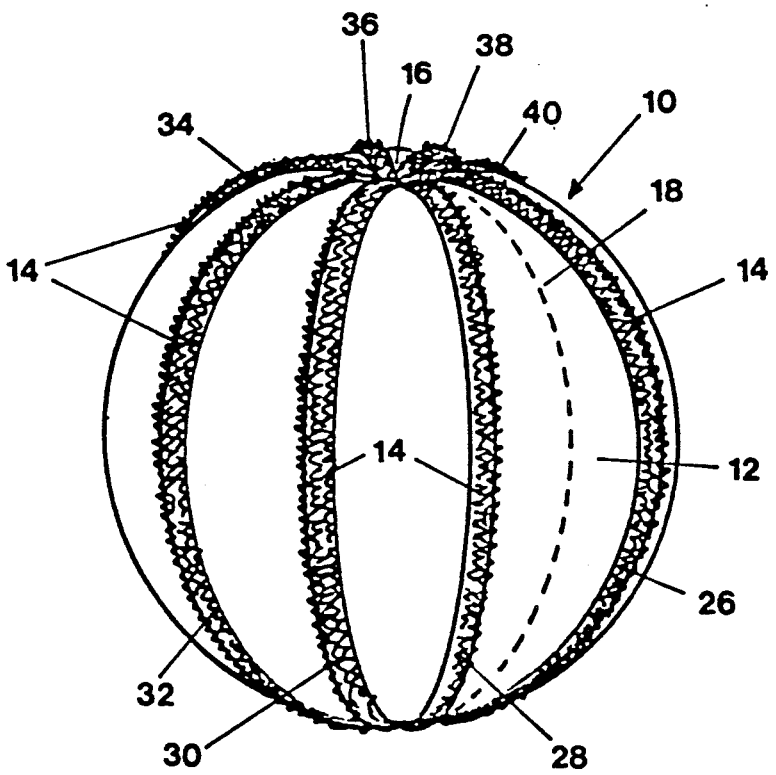
FIG. 1 is a perspective view of the game ball of the invention.

Referring now to FIG. 1, the game ball 10 of the invention is a spherical body of a soft foam elastomer, typically foamed polyurethane, foamed natural or synthetic rubber such as polymers of butadiene, butylene and styrene, isoprene, etc. The particular material used for the ball is not critical provided that the material is an elastomer and the ball 10 thereby has a moderate to high degree of elasticity and bounce, yet is lightweight and sufficiently soft to avoid any potential of injury to the children who play the game.

As illustrated, the exterior surface 12 of the game ball 10 is partially covered with a plurality of spaced-apart bands 14 of fabric. The fabric which is employed is a Velcro® fabric, which is a pile-like fabric formed with upstanding loops that are used with a complimentary material or fabric having outwardly extending hook-like members. The fabric bands 14 on the ball of the invention can be either the hook or loop Velcro® fabric. Preferably, however, only one type of the Velcro® fabric is used on the ball 10, either the loop or the hook type Velcro® fabric bands are employed.

The ball 10 has a central through passageway 16 that extends along a diameter of the ball 10 and, as will be described hereinafter, the bands 14 of the Velcro® fabric lie on arcs of great circles 18 (shown in a phantom line) on the exterior surface 12 of the ball 10, and pass through the interior of the ball along the central through passageway 16.

Figure 2:
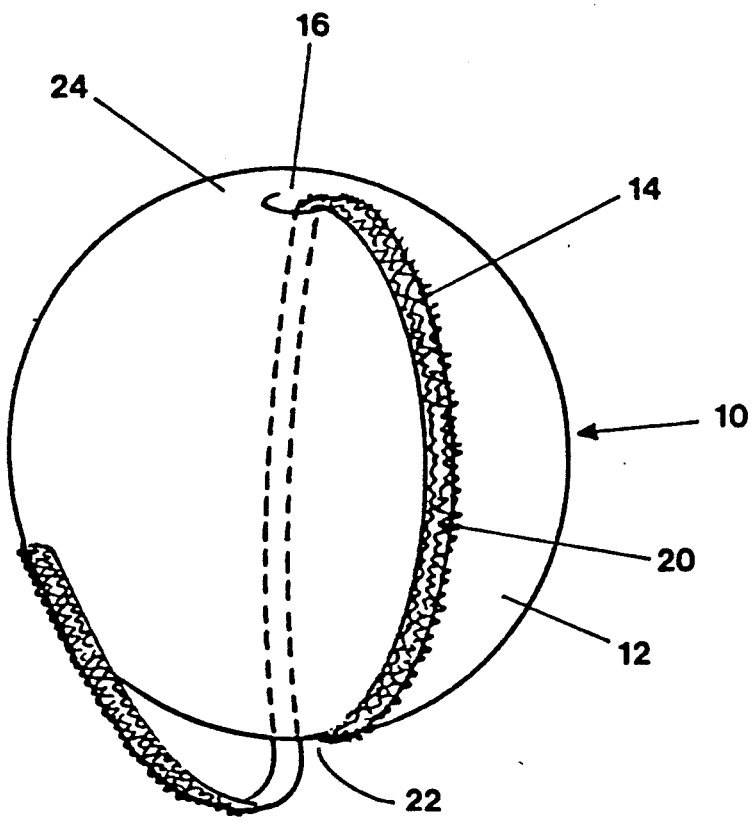
FIG. 2 illustrates the assembly of the game ball of the invention.

Referring now to FIG. 2, the manner of affixing the Velcro® bands 14 to the ball 10 of the invention will be described. As there illustrated, the elastomeric foam ball has a central through passageway 16 and the Velcro® band 14 is passed into the end 24 of the through passageway 16, exiting from its opposite end 22, and is looped over the surface 12 of the ball 10, thereby providing a fabric band portion 20 which lies on a arc which corresponds to a semicircle of a great circle of the ball 10. The band 14 is repeatedly passed along the through passageway 16, exiting from one end 22 and looped across the surface 12 of the ball 10, to provide a plurality of fabric band portions, each of which lies along a semicircular arc of a great circle of the ball. In this fashion, all of the bands on the exterior of the ball can be formed by a single continuous band of the Velcro® fabric by cyclically passing the fabric band through the through passageway, looping it over the exterior surface of the ball and passing it again through the through passageway until the desired number of plurality of bands lying on arcs of great circles is provided on the ball.

Preferably, the strips are glued together and to the surface of the ball. For this purpose, any good fabric cement can be used, e.g., rubber and synthetic rubber cements are satisfactory. This prevents the bands from separating from the ball surface and prevents a child from gripping the ball by grasping only a Velcro® band. The permanency and tightness of the Velcro® band about the ball, however, is obtained by the continuous looping of the Velcro® band through the center of the ball.

Alternatively the plurality of band portions of Velcro® fabric on the exterior surface of the ball of the invention can be provided by separate Velcro® bands, each of which loops through the through passageway and forms a continuous encirclement of a portion of the ball. In this embodiment, each band of Velcro® is bonded to itself within the central passageway 16 to provide a permanent attachment of the Velcro bands to the ball. As previously described, the Velcro® bands are also preferably bonded to the surface of the ball.

Preferably the ball 10 is provided with at least four, and most preferably, eight band portions 26–40 lying on arcs of great circles as shown in FIG. 1.

Figure 3:
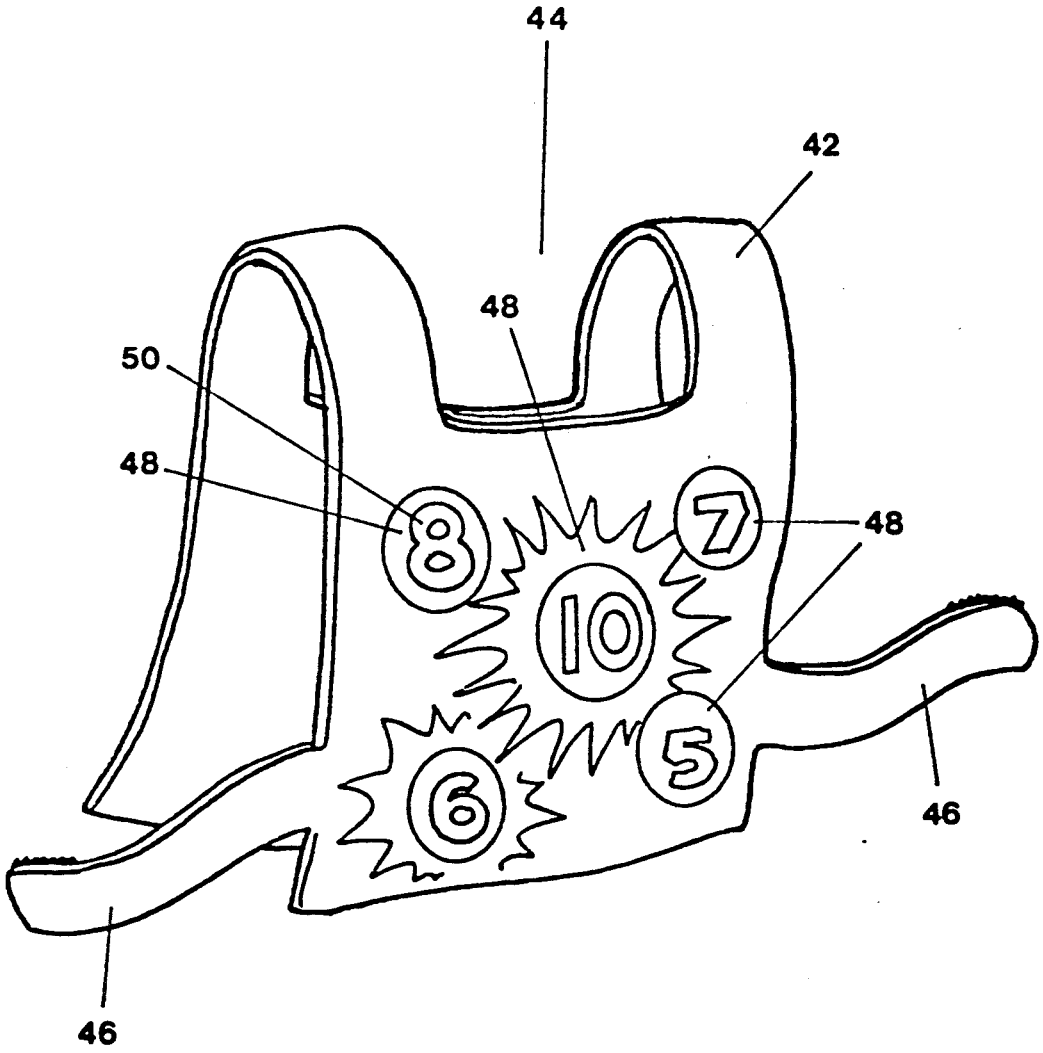
FIG. 3 illustrates the wearing apparel used in the game of the invention.

Referring now to FIG. 3, the wearing apparel for the game of the invention is illustrated. The wearing apparel is a vest 42 that is formed of fabric which is draped over the wearer's shoulders with a cutout 44 for the neck and with side tabs 46 for attachment around the waistband of the wearer. The vest 42 can be formed entirely of the Velcro® material which is complimentary to the Velcro® material selected for the portions 26–40 on the exterior of the ball surface, for example the receptive Velcro® hook fabric could be used for the vest 42 and the complimentary Velcro® hook fabric can be used for the portions 26–40 which cover the ball 10.

The wearing apparel such as vest 42 is provided with targets 48 that are identified by indicia, e.g., the circular targets 48 which are printed on the vest, as shown in FIG. 3. The targets 48 can be identified with numerical indicia such as 50 that assign a particular value to each of the targets 48. The value assigned to each target can be preselected to assign the highest numerical values to those targets which are at critical body organ locations, most difficult to hit, smallest target areas, etc.

As previously mentioned, the wearing apparel such as the vest 42 can be entirely formed of a Velcro® fabric. Alternatively, the vest can be formed of a non-reactive fabric and can be provided with a plurality of patches of the Velcro® fabric which is complimentary to the Velcro® material used on the ball 10.

Figure 4:
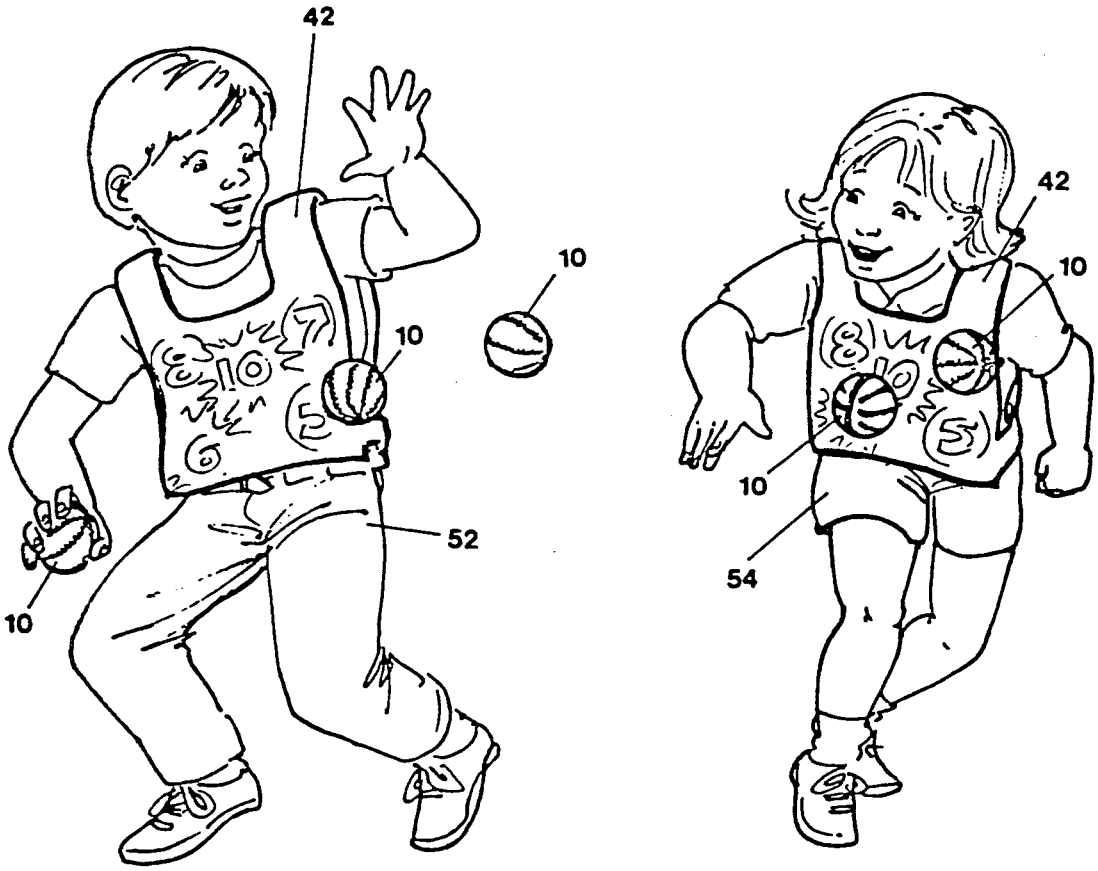
FIG. 4 illustrates children playing the activity game of the invention.

Referring now to FIG. 4, the activity game will be described. The game is played with a plurality of the balls 10 of the invention. One or more of the players 52 and 54 dons the wearing apparel such as the vest 42. In the illustration, both players are provided with a plurality of balls 10, and each of the players wears a target vest 42 of the invention. During the game, each of the players throws the balls 10 at the other player, attempting to strike a target, preferably one of the greatest numerical value. The player wearing the vest 42 attempts to avoid being struck with the balls 10 of the invention, or, alternatively, being struck in a non-target area. For this purpose, the player can dodge or duck the balls and the game thus requires active participation both as a target and as a thrower of the balls. In variations of the game, the indicia can be identified with location on the body, with targets at critical organ areas, such as the heart, lungs, etc., being assigned greatest values, or being assigned a disqualifying value so that when an opponent's ball strikes and adheres to the target, that player must retire from the game. In this variation, the surviving player wins the game.

The ball of the invention is ideally suited for use in an activity game of the nature described and illustrated in FIG. 4, since the ball is formed entirely of soft, elastomeric foam and is partially covered by fabric bands. Since the Velcro® fabric bands are passed continuously into the through passageway of the ball, the seams of the fabric are recessed. This ensures that there are no sharp edges of the Velcro® fabric which could strike a player or cause injury.

Because the Velcro® fabric bands are continuous about the ball and are contained with the ball, the Velcro® fabric bands are very securely fastened to the ball. Consequently the Velcro® bands do not separate from the ball. Instead, the bands flex with the ball as the ball impacts a surface.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A game ball comprising:

a. a solid form spherical body formed of compressible elastomeric foam and having at least one through passageway lying along a diameter thereof;

b. a flexible fabric band comprising Velcro® fabric having a portion lying along the arc of a great circle on the exterior surface between the opposite ends of said through passageway, and extending through said through passageway with its opposite ends secured together within said through passageway, thereby retaining said band onto said body.

2. The game ball of claim 1 wherein said fabric bands are formed entirely of Velcro® fabric.

3. The game ball of claim 1 including at least four portions of said fabric band lying along spaced-apart arcs of great circles of said ball.

4. The game ball of claim 3 wherein said fabric band portions lie along arcs which are spaced at equal angular increments on the surface of said ball.

5. The game ball of claim 1 including eight portions of said fabric band lying along equally spaced apart arcs of great circles of said ball.

6. The game ball of claim 1 wherein said fabric band is a single continuous band which is passed through said passageway about the exterior surface of said and back through said passageway a sufficient number of times to provide at least four portions lying along arcs of great circles on the exterior of said ball.

7. The game ball of claim 6 wherein said fabric band has eight of said portions lying along arcs of great circles on the exterior of said ball.

8. A children's activity game for at least two players wherein the players are provided with a plurality of the balls defined by claim 1, and at least one of the players wears apparel which has at least one target that includes a Velcro® fabric which is complimentary to the Velcro® fabric of said fabric band on said ball, and the other of said players throws said balls at said one player, attempting to cause the thrown balls to attach to said wearing apparel.

9. The game of claim 8 wherein said one player actively attempts to dodge said balls.

10. The game of claim 9 wherein several players are provided with said balls and only one of said players wears said apparel.

11. The game of claim 9 wherein each of the players is provided with a plurality of said balls and each of the players wears said apparel.

12. A game for two or more players which wherein at least one soft ball with an outer surface which includes Velcro® attachment fabric and comprising:

a. a solid form spherical body formed of compressible elastomeric foam and having at least one through passageway lying along a diameter thereof;

b. a flexible fabric band comprising Velcro® fabric having a portion lying along the arc of a great circle on the exterior surface between the opposite ends of said through passageway, and extending through said through passageway with its opposite ends secured together within said through passageway, thereby retaining said band onto said body;

is thrown by a player at another player, who wears apparel which has at least one target that includes a Velcro® fabric which is complimentary to the Velcro® fabric on said ball, thereby providing an attachment surface for said ball, with the purpose of striking said target and adhering said ball thereto.

* * * * *